US005782621A

United States Patent [19]

Harris

[11] Patent Number: 5,782,621

[45] Date of Patent: Jul. 21, 1998

[54] MANUAL PUMP WITH INHERENT VACUUM LIMIT

[75] Inventor: Jesse W. Harris, San Antonio, Tex.

[73] Assignee: Mission Pharmacal Company, San Antonio, Tex.

[21] Appl. No.: 635,475

[22] Filed: Apr. 22, 1996

[51] Int. Cl.[6] ..... F04B 39/10

[52] U.S. Cl. ..... 417/470; 417/544; 417/550; 600/38

[58] Field of Search ..... 417/550, 544, 417/569, 470, 306; 600/38

[56] References Cited

U.S. PATENT DOCUMENTS

| | | | |
|---|---|---|---|
| 1,001,175 | 8/1911 | Siebert, Jr. . | |
| 2,449,805 | 9/1948 | Develay et al. . | |
| 4,718,411 | 1/1988 | Stewart . | |
| 4,806,084 | 2/1989 | Neward | 417/569 X |
| 5,020,522 | 6/1991 | Stewart . | |
| 5,421,808 | 6/1995 | Osbon et al. | 600/38 |
| 5,462,514 | 10/1995 | Harris . | |

FOREIGN PATENT DOCUMENTS

| | | | |
|---|---|---|---|
| 7006822 | 11/1987 | WIPO | 600/38 |

*Primary Examiner*—Ismael Izaguirre

*Attorney, Agent, or Firm*—Charles W. Hanor; Kirt S. O'Neill

[57] ABSTRACT

A vacuum pump useful in penile erection systems is provided. The vacuum pump comprises a piston in a cylinder with intake and exhaust valves. The vacuum producing outstroke is powered by a spring having sufficient force to draw a vacuum no higher than the desired upper safety limit, and the reset stroke is powered manually. The pump is constructed to provide an inherent vacuum limit by selecting a spring which, when fully compressed during a reset stroke, exerts a force against the piston which is less than the force exerted against the piston head by the differential pressure between atmospheric pressure and a preselected maximum vacuum pressure inside the cylinder. Thus, when the maximum vacuum pressure is reached, the piston is not returned for successive pumping. An added safety measure is provided by a pump housing of sufficient length to enclose the pump actuator when the piston is in the reset position, thereby preventing the user from intentionally continuing to operate the pump after the preselected maximum vacuum pressure is reached.

11 Claims, 4 Drawing Sheets

MANUAL PUMP WITH INHERENT VACUUM LIMIT

FIELD OF THE INVENTION

The present invention is in the field of vacuum pumping mechanisms. More particularly, the present invention relates to a hand pump suitable for creating a partial vacuum in devices used for producing penile erections.

BACKGROUND OF THE INVENTION

Male impotence is a common medical problem, and it is often accompanied by severe physiological and psychological effects on those men so afflicted. Although there are many causes of this problem, it is the symptom itself—impotence—which is the most important aspect of the affliction to most sufferers.

Several methods for overcoming this condition are now available. One is the use of semi-flexible rods surgically implanted in the penis to produce a permanent semi-erection. Another method is the implantation of slim tubular balloons which can be inflated from a reservoir when it is desired to have an erection. Perhaps the most widely accepted method involves the use of a vacuum pump to reduce the pressure below atmospheric in a cylinder placed over the penis. This reduced pressure induces the penis to fill with blood and become erect. A constriction device is then placed over the base of the penis to restrict blood outflow, and the erection is thereby maintained. Due to the tourniquet effect of this restriction, it should not be left in place more than about twenty minutes. Since this is longer than most men can maintain a natural erection, the system has been well received by most users.

Vacuum based systems are illustrated in a number of patents. U.S. Pat. No. 5,462,514 to Harris is representative in its illustration of the components and principles involved in these systems.

Although vacuum-based erection systems are widely used and work satisfactorily for most men, medical complications can result from excessive vacuum levels if these systems fail or are improperly designed. Ecchymosis, hematoma, skin necrosis and Peyronies disease resulting from excessive vacuum levels have all been reported.

Most, though not all, erection systems of this type are nominally protected by vacuum-limiting bypass valves. These vacuum relief valves are expected to protect users from vacuum levels above some predetermined level deemed to be safe by the system designer. The vacuum producing pumps are usually capable of drawing vacuums far above such safe levels, so that the relief valve's reliability is of great importance from the standpoint of user health and safety.

However, practical considerations of cost, portability, storage size and aesthetics usually dictate that such vacuum control valves be simple and quite small. They are almost universally of a poppet-type moving element urged against its seat by a small, weak spring and opposed by a force whose magnitude is obtained by multiplying the area of the poppet valve head by the difference in pressure between atmospheric pressure and vacuum pressure. When the poppet valve head area is of a size commonly used in these devices (approximately ½ inch in diameter) and the vacuum level to be maintained is quite low, the spring force exerted against the poppet is typically less than one pound.

Further affecting the reliability of such designs, these units are often used with liberal quantities of relatively thick lubricating jelly applied to associated parts of the system, including the erection cylinder and restrictor application cone. Lubricant may also be applied to the penis, and may get on the hands and fingers of the user. Therefore, the valve often becomes contaminated in its sealing and/or sliding and air inlet areas. Any contamination which causes the valve action to become "sticky" or to resist sliding will raise the vacuum required to open the valve. A jelly-coated hand or finger placed over the inlet of the valve may partially or completely prevent it from functioning. If, as is often the case, the user is in an excited or intoxicated state, the likelihood of such an event resulting in injury increases.

In the present climate of strict legal liability against manufacturers, it is desirable to reduce the incidence of excessive vacuum resulting from device malfunction or improper use. It is also desirable that this be done without incurring excessive cost.

Accordingly, it is an object of the present invention to provide a pumping device with an inherent vacuum limit so that predetermined vacuum levels are not exceeded during normal operation by the user.

A further object of the present invention is to provide a pumping device in which the maximum vacuum level attainable is inherent in the pump's construction so that the vacuum control valve can be eliminated.

A further object of the present invention is to provide a pumping device whose construction prevents the user from purposely exceeding the predetermined, inherent vacuum limit by manually overriding the vacuum limiting features of the device.

A further object of the present invention is to provide a hand pump of simplified design and lower-cost construction.

A further object of the present invention is to provide a pumping unit of reduced overall size which can be stored entirely within the erection cylinder of an associated penile erection system.

SUMMARY OF THE INVENTION

The present invention comprises a spring-driven piston within a cylinder, the piston being hand-operable by the user to establish a vacuum within the cylinder. The cylinder is in fluid communication with a reservoir (e.g., a penile erection device) to be evacuated via an intake valve through the blind end of said cylinder so that air is drawn into the cylinder from the reservoir on the spring-driven outstroke of the piston. An exhaust valve through the head of said piston permits air to pass through the piston head and be vented to the atmosphere on the hand-powered "reset" or instroke.

The spring which urges the piston to its fully open position is engineered to exert specific forces at the fully compressed and fully extended conditions reached within the pumping unit. Specifically, the spring is engineered so that, when fully compressed, the force it exerts against the piston is less than the force exerted against the piston by the pressure differential existing between the interior and the exterior of the cylinder (together with sliding friction of the piston head) above a predetermined maximum vacuum level. Accordingly, there is established for the device a maximum attainable vacuum level beyond which the piston is prevented from opening to allow the user to continue the pumping action.

In the present invention, increases in friction resulting from contaminants, wear, and loss of spring force through age, corrosion or use can only decrease maximum attainable vacuum. With this unit, safety against inadvertent excess vacuum levels is maximized. In the invention, the cylinder housing and pump actuator are also designed to discourage the user from grasping the actuator and continuing the pumping action beyond the point at which the maximum design vacuum level is achieved. This feature provides an added level of safety protection by ensuring that the user does not manually "override" the design vacumm limit of the pump.

DESCRIPTION OF THE PREFERRED EMBODIMENT

Figure 1:
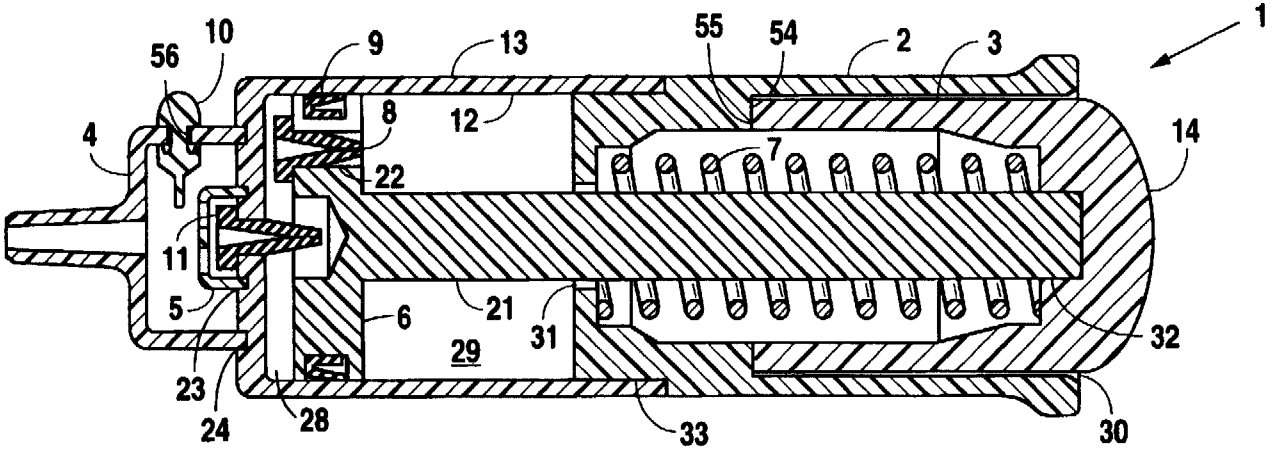
FIG. 1 is a cross-sectional view of a manual vacuum pump unit in a "reset" or fully closed position.

FIG. 1 illustrates an embodiment of a hand-powered vacuum pump designed for use in a penile-erection system in which the vacuum produced must not exceed a preselected or "design" level. The assembled pump unit 1, shown (FIG. 1) in its closed position (spring 7 at maximum compression), includes other major components: piston 6, bore casing 13, housing 2, hose adapter 4, and knob 3 for actuating the piston. Other elements of the assembly include air check valves 8 and 11, retainer cap 5, vacuum breaker 10 and cup or lip seal 9.

Figure 2:
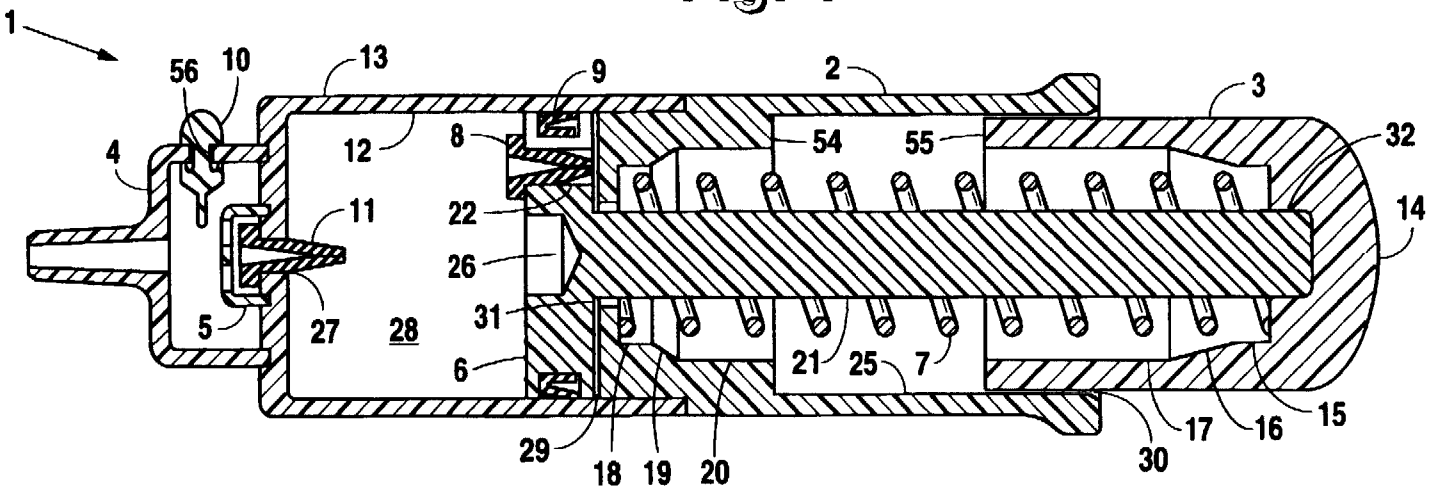
FIG. 2 is a cross-sectional view of a manual vacuum pump unit in extended or fully open position.

FIG. 2 illustrates the pump of FIG. 1 in the open position (spring 7 at maximum extension, corresponding to the position of the piston at completion of an outward stroke).

Referring to FIGS. 1 and 2, the pump unit 1 may be adhesively assembled from a number of generally cylindrical components. Housing 2, knob 3 and bore casing 13 are rotationally symmetrical about a longitudinal axis of the pump unit. Piston 6 and hose adapter 4 are also rotationally symmetrical except that piston 6 has an aperture 22 in which a valve 8 is mounted, and adapter 4 has an aperture 56 in which to mount vacuum breaker 10. Valve retainer cap 5 of FIG. 1 is also shown in detail in FIGS. 4A and 4B (with projection 47 added).

With all parts assembled as shown in FIGS. 1 and 2, including airtight assembly joints in grooves at 23 and 24 and high strength joints at 32 and 33, spring 7 is captured between spring seat 18 of housing 2 and spring seat 15 of knob 3. A short distance above housing spring seat 18, internal housing diameter is increased to diameter 20 via taper 19. The same increase to diameter 17 via taper 16 occurs in actuating knob 3.

Spring 7 may be designed to have a free length more than twice the distance between said spring seats, even in its extended position (FIG. 2). Therefore, spring 7 exerts a force outward against actuating knob 3 and through its connection to piston 6 tending to pull piston 6 toward the base of housing 2 in an outward stroke, increasing the volume of cavity 28 and decreasing the volume of cavity 29. However, because cavity 29 is open to the atmosphere through gap 31 (FIG. 1) between piston stem 21 and the base of housing 2 and then through gap 30 between actuating knob 3 and the interior surface 25 of housing 2, air entering this area immediately escapes into the atmosphere. Pressure buildup in cavity 29 is both very small and of only momentary duration. Relative to other forces in the system, it is insignificant.

In operation, pump unit 1 as shown on FIG. 2 is held in the hand by the exterior surface of the assembly comprising bore casing 13 and housing 2. The thumb of that hand or the palm of the other hand (or any convenient surface) is used to apply pressure on surface 14 of actuating knob 3 in order to compress spring 7 and produce the fully closed condition shown in FIG. 1.

Moving piston 6 from the fully open position of FIG. 2 to the fully closed position of FIG. 1 through the completion of an inward stroke decreases the volume of cavity 28 from maximum to minimum and tends to increase pressure in this cavity (under the piston head). This same motion increases the volume of cavity 29 from almost nothing to the maximum, tending to decrease pressure in this cavity (over the piston). This motion also compresses spring 7. As a result of this movement, differential pressure created across the head of piston 6 activates check valve 8 and passes air through said valve mounted in aperture 22 of piston 6. Due to the low activation pressure of check valve 8 and the fact that pressure is slightly reduced on its exhaust side (cavity 29), pressure remaining in the minimal volume of cavity 28 (FIG. 1) is very nearly at atmospheric.

With spring 7 fully compressed and the volume of cavity 28 at a minimum; the force applied at knob 3 is removed and spring 7 urges against piston 6, moving it outwardly. This increases the volume of cavity 28 and tends to lower the pressure therein. At the same time it decreases the volume of cavity 29 and tends to raise its pressure above atmospheric. As previously noted, venting to the atmosphere keeps this increase low, and it is quickly dissipated.

As pressure within cavity 28 is reduced below the pressure inside hose adapter 4, check valve 11 is activated and air enters cavity 28, producing a lower pressure inside adapter 4 and any other sealed cavity or reservoir connected thereto (e.g., a cylinder placed over the penis for inducing an erection). Repeated pump cycles further reduce pressure in said attached reservoir. As the number of pump cycles increases, pressure in cavity 28 is continuously lowered (i.e., vacuum is increased). This raises the force required from spring 7 to move the piston outwardly.

When the spring force is balanced by the pressure differential across the area of the head of piston 6, plus the sliding friction of the piston, pumping will no longer occur, and maximum vacuum will have been reached. With spring 7 engineered to a given force level at a given length, the preselected vacuum level cannot be exceeded by inadvertent misuse.

In addition, pump housing 2 may be designed to be of sufficient length so that knob 3 cannot be easily grasped by the user when the unit is in this fully closed position (FIG. 1). Such a design prevents intentional misuse by the user, adding yet another measure of safety against excessive vacuum levels.

Figure 3A:
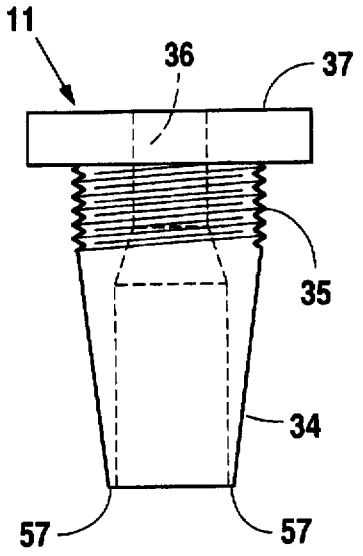
FIGS. 3A and 3B are, respectively, front and side views of a bull-tongue type check valve.
Figure 3B:
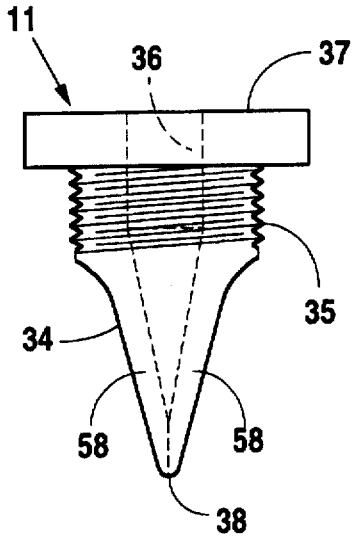

FIGS. 3A, 3B, 4A, 4B, 5A, 5B, 6 and 7 show various other components and features of a manual vacuum unit according to the present invention. FIG. 3A is a front view and FIG. 3B is a side view of a tubular check valve 11 made from a medium durometer resilient material. For this application it is small (diameter at cylindrical portion 35, approximately 3/16 inch). Circular upper flange 37 lies above cylindrical section 35 which has a rough exterior to aid its grip when pressed into a mounting hole. Adhesive may be used to enhance said grip. Tapered section 34 below cylindrical section 35 is laterally flattened into a wedge shape as viewed from the side, and into a modified wedge (broad trapezoid) as viewed from the front. Interior cavity 36 is cylindrical down to the upper edge of tapered section 34 where it spreads laterally in the front view and narrows in the side view passing down through tapered section 34. The form of this cavity is indicated by dotted lines in the drawings. At tip 38, cavity 36 has width only. Air check valve 11 has two flexible lips 58 in light contact connected at the sides of said lips by material as shown at the bottom outside corners 57 of air check valve 11 (FIG. 3A). In relaxed position, these lips have little or no contact pressure, but they touch or are at most a few thousandths of an inch apart. When air pressure is exerted from the flange side, it spreads said lips apart, forming a passageway through which air passes easily. When air pressure is exerted from the opposite direction, it presses said lips together and forms an effective seal. This type of one-way check valve is commercially available in a range of sizes. Valve 8, connecting cavities 28 and 29, is also shown in this configuration.

Figure 4A:
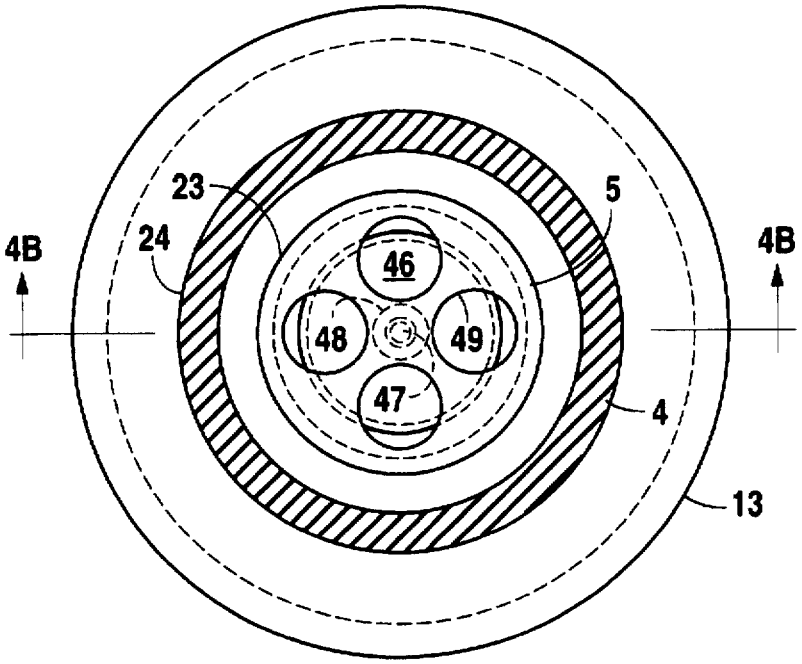
FIGS. 4A and 4B are, respectively, top and side views of a flexible disc type air check valve.
Figure 4B:
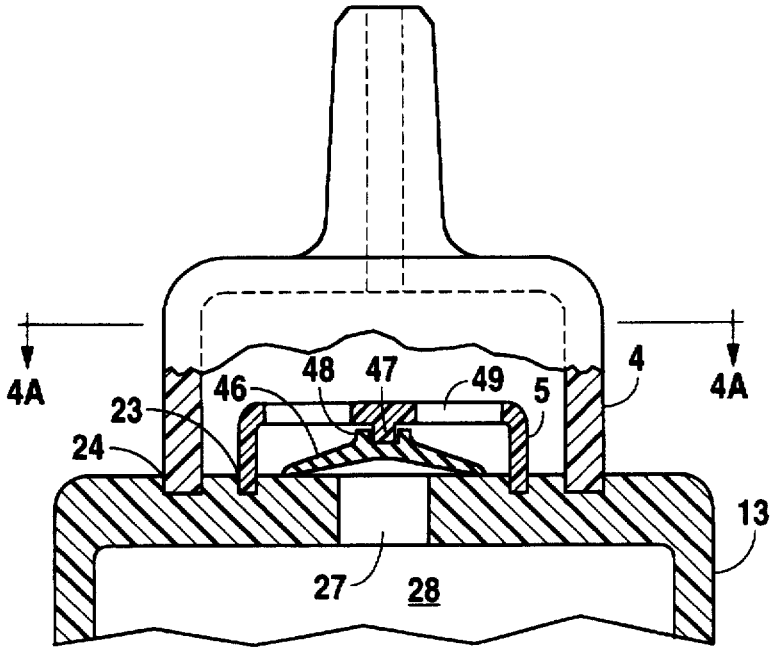

FIGS. 4A and 4B show an alternative form of air check valve suitable for use in the pump of the present invention. It has the advantage of lower operating pressure losses, but possesses the disadvantage of not being commercially available. In this air check valve, the end closure area of bore casing 13 is shown with valve retainer cap 5 mounted thereon and attached to said housing at groove 23. Four holes 49 provide air is passages through retainer cap 5, and projection 47 fits into recess 48 of flexible disc 46 in order to maintain disc 46 in position over aperture 27. When air pressure in the volume of cavity 28 is greater than air pressure inside hose adapter 4, the edges of disc 46 are raised and air passes through. Reverse pressure situations press disc 46 to the surface of bore casing 13 and seals aperture 27 against backflow. This unit may be designed for very low pressure drop when low durometer material and thin edges are used in the flexible disc.

Figure 5A:
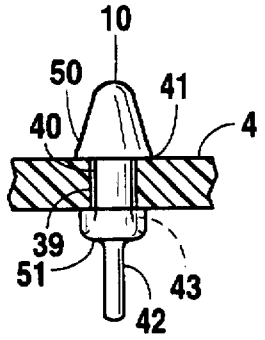
FIGS. 5A and 5B are side views of a vacuum-breaker valve in sealing and open positions, respectively.
Figure 5B:
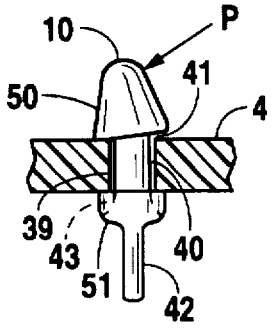

FIGS. 5A and 5B are cross-sectional views of vacuum breaker 10 installed through a wall of hose adapter 4. Head 50 fits tightly against the outer surface of said wall, forming an air seal at abutment 41 and held in contact by tension in slightly stretched breaker stem 40. Vacuum breaker 10 is anchored on the opposite side from head 50 by retaining knob 51. Knob 51 has a multiplicity of cut-outs 43 which prevent said knob from forming an airtight seal at its contact with the wall of hose adapter 4. Pigtail 42 is used to pull breaker 10 into aperture 39 for installation.

To operate vacuum breaker 10, a finger is pressed against the side of head 50 as shown in FIG. 5B by arrow P. This lifts the side of head 50 and breaks the seal at abutment 41. Air passes through aperture 39 through the gap between aperture 39 and the smaller diameter stem 40 and then into hose adapter 4 through the cut-outs 43. By moderating pressure at P, vacuum can be relieved at the desired rate and to the desired level.

Figure 6:
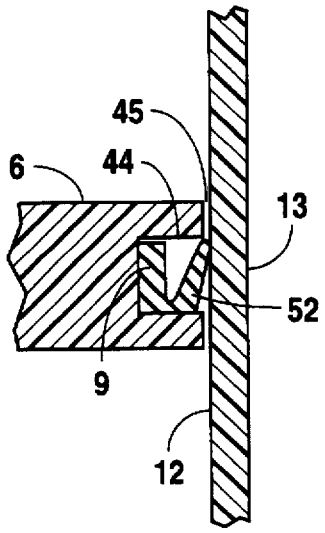
FIG. 6 is an enlarged and detailed cross-sectional view of seal 9 and its relation to adjacent structures.

FIG. 6 is an enlarged and more detailed cross-sectional view of piston seal 9 in place in piston 6 and sealing against cylinder inner surface 12 (FIG. 1). Piston 6 has a sealing element groove 44 around its head in which lip seal element 9 is installed as shown. Bore casing 13 has a smooth inner sealing surface 12. Gap 45 is formed by the radial difference between the head of piston 6 and the inner surface 12 of the inside wall of bore casing 13. This gap must be wide enough to compensate for maximum and minimum tolerances of both parts and still ensure that contact friction will not occur. It must also be small enough to avoid alignment problems. Lip 52 of seal 9 has enough lateral displacement to form an air seal at maximum piston-to-cylinder wall tolerance, and it also has sufficient flexibility to seal at minimum piston-to-cylinder wall tolerance without significant increase in sliding friction. A lip-type or deep u-cup seal may fulfill these requirements.

Figure 7:
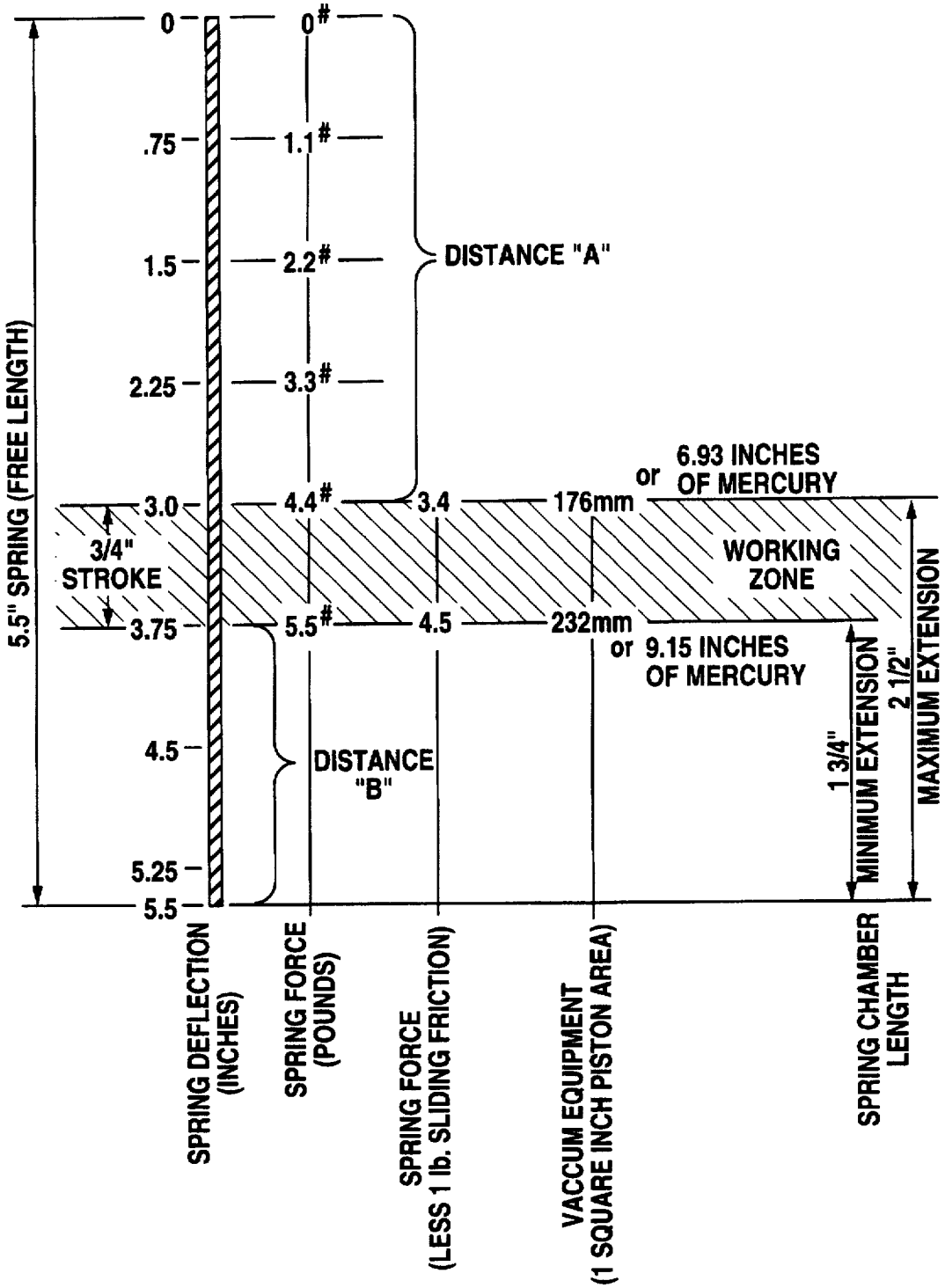
FIG. 7 is a chart showing fundamental requirements for a spring designed for use in a manual vacuum pump.

FIG. 7 is a graph of spring forces vs. length for a uniformly wound compression spring. The graph shows the basic considerations for designing a suitable spring for a pump according to the present invention. A fundamental characteristic of compression springs is that the force exerted by the spring increases linearly with deflection distance as long as the yield strength of the spring material is not exceeded. Thus, a spring having a "spring rate" of 1.85 pounds per inch would exert 3.7 pounds of force when it is compressed two inches ($2\times1.85=3.7$). Factors which influence spring rate include the material from which the spring wire is constructed; the wire diameter; the diameter of the coil; and the coil pitch (distance from one coil to the next). Engineering formulae covering these factors allow a designer to custom-fit a spring to its task.

The characteristics of the spring 7 are determined in part by the physical design of the pump unit. Stroke length of pump unit 1 is controlled by positive mechanical stops. Extension is limited by the head of piston 6 abutting the base of housing 2. The compression (hand-powered) stroke is limited by the abutment of shelf 54 of housing 2 against the lower surface 55 of knob 3. In the preferred embodiment, a stroke length of ¾ inch is employed, which coincides with the extent of compression of the spring 7. Note the cavity 26 in the head of piston 6 which allows the piston head to approach the head end of bore casing 13 without striking valve 11 (FIG. 1).

Once the stroke length is determined, the forces to be exerted by the spring at the positions of maximum and minimum deflection are calculated to arrive at the spring rate. These forces will be a function of the the maximum and minimum vacuum pressures in the cylinder when the piston is fully depressed and undepressed, respectively. FIG. 7 shows a spring selected to operate with a piston having a one square inch surface area, and to be operable between a maximum vacuum pressure of 232 mm Hg and a minimum vacuum pressure of 176 mm Hg. The maximum vacuum pressure is selected based on the medically recommended maximum vacuum pressure for inducing an erection in males, and may be higher or lower than this 176 mm Hg figure depending on the intended user and his medical condition. The vacuum pressure corresponding to an undepressed piston (partially deflected spring) is selected by determining the vacuum pressure at which the piston and its accompanying actuating knob are no longer to be returned to the fully open position. This pressure may correspond to the lowest vacuum pressure at which an erection-aiding apparatus is likely to function properly; at lower vacuum levels, the piston is returned to its fully open position by the spring, while at successively higher vacuum levels, the piston is returned to positions affording successively shorter stroke lengths of the piston.

From these maximum and minimum vacuum pressures and the surface area of the piston, one can calculate the maximum and minimum forces to be exerted by the spring. In the preferred embodiment, these forces are 4.5 pounds and 3.4 pounds, respectively. Because the spring must also overcome the force of sliding friction as the piston is returned to a fully open position, an appropriate sliding friction force (here, one pound) is added to the aforementioned maximum and minimum forces. Making this correction, the spring is required to exert a maximum force of 5.5 pounds in its fully deflected (FIG. 1) state, and a minimum force of 4.4 pounds in its less deflected state (FIG. 2). In the example shown, the total amount of deflection is ¾ inch. Thus, the spring rate is thus 1.1 pounds per ¾ inch, or 1.467 pounds per inch.

FIG. 7 graphically shows the relationship of maximum and minimum vacuum pressures, maximum and minimum spring forces, and spring deflection in the preferred embodiment. It can be seen by studying the graph that the extra element of length A must be added in order to get enough compression to build up to the lower force level and that the spring rate is fixed by the force required after a further ¾ inch of compression. Free length is the length of a completely unloaded spring, so in this case it is the sum of distance A plus the stroke length plus an arbitrary distance B which allows room for all the coils and prevents overstress from collapsing the spring too completely. In actuality, the lower unit vacuum of 232 mm Hg can never be achieved because the stroke length at that level of vacuum would be zero, but vacuums near 220 mm Hg are attainable by rapidly short-stroking the pump. Obviously, any vacuum level above 176 mm Hg will shorten the stroke because the spring will run out of force to lift the piston above the stroke point corresponding to that vacuum level.

While a particular embodiment of the invention has been illustrated and described, it will be obvious to those skilled in the art that various changes and modifications may be made without sacrificing the advantages provided by the principle of construction disclosed herein.

I claim:

1. A vacuum pump apparatus with an inherent vacuum limit, comprising:

a piston having a shaft, said piston being movable within a bore casing and capable of drawing a vacuum in an end thereof;

actuator means coupled to said piston for moving the piston into said bore casing in an inward stroke;

means for evacuating air from said bore casing when the piston is moved in an inward stroke;

means connecting said bore casing to a reservoir to be evacuated for admitting air from said reservoir into the bore casing when said piston is moved in an outward stroke; and means coupled to said piston for moving the piston in an outward stroke, said moving means operable to move the piston only when said vacuum is below a predetermined limit.

2. The vacuum pump of claim 1, further comprising a pump housing at least partially enclosing said piston shaft, said actuator means being disposed substantially within said pump housing after said piston completes an inward stroke.

3. The vacuum pump of claim 1, wherein said piston moving means comprises a spring adapted to exert a force against the piston.

4. The vacuum pump of claim 1, wherein said air evacuating means comprises an air check valve.

5. The vacuum pump of claim 3, wherein said means for admitting air comprises an air check valve.

6. A vacuum pump apparatus for aiding erections in males with vacuum levels inherently limited by the pump's construction, comprising:

a piston having a shaft, said piston being movable within a bore casing and capable of drawing a vacuum in an end thereof;

adaptor means adjacent an exterior wall of said end of the bore casing for placing the bore casing in fluid communication with a penile erection device through a hose;

an actuator coupled to said piston for moving the piston into said bore casing in an inward stroke;

means for evacuating air from said bore casing when the piston is moved in an inward stroke; and means coupled to said piston for moving the piston in an outward stroke, said moving means operable to move the piston only when said vacuum does not exceed a predetermined limit.

7. The vacuum pump of claim 6, further comprising a pump housing at least partially enclosing said piston shaft, said actuator means being disposed substantially within said pump housing after said piston completes an inward stroke.

8. The vacuum pump of claim 6, wherein said piston moving means comprises a spring adapted to exert a force against the piston.

9. The vacuum pump of claim 6, wherein said air evacuating means comprises an air check valve.

10. The vacuum pump of claim 6, further comprising means formed through said adaptor means for manually releasing said vacuum.

11. A vacuum pump apparatus for aiding erections in males with vacuum levels inherently limited by the pump's construction, comprising:

a piston having a shaft, said piston being movable within a bore casing and capable of drawing a vacuum in an end thereof;

adaptor means adjacent an exterior wall of said end of the bore casing for placing the bore casing in fluid communication with a penile erection device;

a pump housing at least partially enclosing said piston shaft;

an actuator coupled to said piston for moving the piston into said bore casing in an inward stroke, said actuator being disposed substantially within said pump housing after said piston completes an inward stroke;

an air check valve mounted in said piston for evacuating air past said piston from within said pump housing when the piston is moved in an inward stroke;

an air check valve connecting said pump housing to a cavity to be evacuated when said piston is moved in an outward stroke; and a spring coupled to said piston for moving the piston outward from said pump housing in an outward stroke, said spring operable only when said vacuum does not exceed a predetermined limit.

* * * * *